US007234794B2

(12) United States Patent
Lim et al.

(10) Patent No.: US 7,234,794 B2
(45) Date of Patent: Jun. 26, 2007

(54) IMAGE FORMING APPARATUS WITH DUST COLLECTOR

(75) Inventors: Gui-Taek Lim, Suwon-si (KR); Tae-Kyun Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 257 days.

(21) Appl. No.: 11/044,039

(22) Filed: Jan. 28, 2005

(65) Prior Publication Data

US 2006/0033786 A1 Feb. 16, 2006

(30) Foreign Application Priority Data

Aug. 10, 2004 (KR) ..... 10-2004-0062948

(51) Int. Cl.
*B41J 2/165* (2006.01)
*B41J 2/175* (2006.01)
*B41J 2/17* (2006.01)

(52) U.S. Cl. ..... 347/34; 347/36; 347/86; 347/84; 347/85

(58) Field of Classification Search ..... None
See application file for complete search history.

(56) References Cited

FOREIGN PATENT DOCUMENTS

| | | |
|---|---|---|
| JP | 63-114658 | 5/1988 |
| JP | 10-264412 | 10/1998 |
| JP | 2002-211005 | 7/2002 |
| JP | 2003-341109 | 12/2003 |

*Primary Examiner*—Lamson Nguyen
*Assistant Examiner*—Sarah Al-Hashimi
(74) *Attorney, Agent, or Firm*—Stanzione & Kim, LLP

(57) ABSTRACT

An image forming apparatus provided with a dust collecting part includes an ink cartridge having a wide array type ink jet head that is capable of ejecting ink over an entire lateral line that is perpendicular to a conveying direction of a recording medium at a time, and a main body case that supports the ink cartridge, a duct located under the wide array type ink jet head to extend in a longitudinal direction of the wide array type ink jet head; and a dust collecting part including a charging part disposed in the duct to charge impurities and electrodes disposed in the duct to adsorb the charged impurities The image forming apparatus includes a dust-collecting part that adsorbs the impurities over an entire region of the wide array type ink jet head, thereby effectively removing the impurities generated in large quantities and increasing a life span and a reliability of image forming apparatuses, since the dust collecting part is securely maintained during operation.

28 Claims, 7 Drawing Sheets

IMAGE FORMING APPARATUS WITH DUST COLLECTOR

CROSS-REFERENCE TO RELATED APPLICATIONS

This application claims the benefit of Korean Patent Application No. 2004-62948filed on Aug. 10, 2004, the disclosure of which is hereby incorporated herein by reference in its entirety.

BACKGROUND OF THE INVENTION

1. Field of the Invention

The present general inventive concept relates to an image forming apparatus having a dust collecting part, and more particularly, to an image forming apparatus having an ink cartridge with a wide array type ink jet head that is capable of printing an entire lateral line of a recording medium at a time, and a device that removes impurities, such as ink mists, dust, or particles, from the image forming apparatus.

2. Description of the Related Art

An ink jet printer is a device for printing a desired image or text by ejecting ink stored in a cartridge onto a recording medium through an ejecting part, typically a nozzle of an ink jet head. Ink jet printers have been widely used due to their low cost and the ease with which color printing is implemented.

Referring to FIG. 1, a conventional type of ink jet printer is partially illustrated. In FIG. 1, a main body frame 10 is installed in a printer main body to support devices and install various parts. The main body frame 10 is provided with a guide bar 12 at its lower portion and an upper guide 14 at its upper portion. A carriage 20 is installed at the guide bar 12 and the upper guide 14. A slider 24 is formed at a top surface 22 of the carriage 20, and the slider 24 is mounted onto the upper guide 14. In addition, ink cartridges 26 and 28 are mounted in the carriage 20.

The carriage 20 laterally slides along the guide bar 12 and is driven by a driving part (not shown) above a surface of a recording medium P to perform a printing operation. In this process, ink ejected from an ink jet head of the ink cartridges 26 and 28 partially remains on a surface of the ink jet head and agglomerates there. The surface of the ink jet head becomes contaminated due to dust, particles, and ink mists introduced from the recording medium P or an exterior. As a result, a nozzle of the ink jet head may become blocked and printing quality may deteriorate. In addition, since the ink remaining on the ink jet head agglomerates and blocks the nozzle when the printing operation is not performed for an extended period of time, it becomes necessary to store the ink jet head in an enclosed state when the ink jet head is not in use. Therefore, a service station 30 is installed at one end of the main body frame 10 to perform these functions.

Recently, a printing speed of ink jet printers has been improved with the development of a wide array type ink jet head, because the wide array type ink jet head extends along an entire width of the recording medium and is capable of printing on a recording medium one entire lateral line at a time. Since one entire lateral line of the recording medium may be printed at a time without a reciprocating movement of the ink jet head, the printing speed may be improved. A structure of the printer may be simplified, because it is unnecessary to move an ink cartridge laterally to reach the entire width of the recording medium. In other words, by increasing the length of the ink jet head to correspond to the width of the recording medium, rather than laterally moving the conventional ink jet head along a lateral direction of the recording medium, the printing speed is improved.

However, in the wide array type ink jet head, since a region from which ink is ejected is significantly widened in comparison with the conventional type ink jet head, more impurities, such as ink mists, dust, particles, etc., are generated. In addition, although the impurities should be more thoroughly removed from the wide array type ink jet head due to an increased probability of contamination of the wide array type ink jet head, a wiping part is insufficient to remove the impurities, because wiping the wide array type ink jet head becomes more difficult than the conventional ink jet head.

SUMMARY OF THE INVENTION

The present general inventive concept provides an image forming apparatus including a dust collecting part capable of effectively adsorbing impurities, such as dust, particles, ink mists, etc., generated by an ink jet head. In particular, the present general inventive concept may be used to adsorb impurities generated by an wide array type ink jet head.

The present general inventive concept provides an image forming apparatus including a dust-collecting part on which maintenance is made easy by allowing impurities to be adsorbed and readily removed.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing an image forming apparatus including an ink cartridge having a wide array type ink jet head that is capable of ejecting ink over an entire lateral line that is perpendicular to a conveying direction of a recording medium at a time; and a main body case that supports the ink cartridge, a duct located under the wide array type ink jet head to extend in a longitudinal direction of the wide array type ink jet head, and a dust collecting part including a charging part disposed in the duct to charge impurities and electrodes disposed in the duct to adsorb the charged impurities.

The present general inventive concept is capable of removing the impurities by charging the impurities, such as ink mists, dust, particles, or other impurities, generated during a printing operation, to have a positive or a negative electric charge and then adsorbing the charged impurities using the electrodes. Since the duct functions as a passage where air containing the impurities moves, and extends in a longitudinal direction of the wide array type ink jet head, the duct may remove the impurities over an entire region of the wide array type ink jet head. Since the impurities may be adsorbed with the all components being fixed, its structure and manufacturing process is simplified. The charging part and the electrodes have different polarities from each other. That is, when the charging part has a negative polarity, the electrodes have a positive polarity and vice versa.

A dust collector according to the present general inventive concept may include the duct, the charging part, and the electrodes.

The charging part may include at least one wire disposed in a longitudinal direction of the duct, and the electrodes may be attached to an inner wall surface of the duct. Since the duct is located under the wide array type ink jet head, the wire is disposed adjacent to the wide array type ink jet head to charge the impurities and to allow the impurities having a polarity to be adsorbed to the electrodes attached to the inner wall surface of the duct.

The electrodes may be detachably mounted in order to exchange the electrodes when their surface becomes contaminated due to a long term use, or to reuse after cleaning, thereby facilitating maintenance.

In order to remove the impurities more efficiently, a fan that discharges the air in the duct to an exterior may be mounted on one end of the duct. Therefore, outside air containing the impurities may be introduced from a top surface of the duct and then moved along the longitudinal direction of the duct to be discharged through the one end of the duct, thereby allowing the impurities to be effectively adsorbed.

While the duct may be manufactured as a separate structure, the duct may also be made as a groove formed under the ink cartridge at a bottom surface of the main body case. In this case, a cover provided with a plurality of slits may be mounted on the groove. Therefore, since the recording medium passes over a top surface of the cover to perform the printing operation, the top surface of the cover may be located lower than the bottom surface of the main body case such that it does not contact a rear surface of the recording medium.

The foregoing and/or other aspects and advantages of the present general inventive concept may be achieved by providing an image forming apparatus including an ink cartridge having a wide array type ink jet head that is capable of ejecting ink over an entire lateral line that is perpendicular to a conveying direction of a recording medium at a time; and a main body case that supports the ink cartridge, a duct protruding from a bottom surface of the main body case, and into which a portion of a bottom surface of the ink cartridge is inserted, a collection body disposed at one end of the duct having an inlet port that receives air from the duct and an outlet port that discharges the air in the duct, at least one charging part disposed at the inlet port to charge impurities that are received in from the duct; and electrodes attached to an inner wall surface of the collection body to adsorb the charged impurities.

The present general inventive concept is capable of efficiently removing the impurities using a small sized dust collecting part by disposing the dust collecting part including the collection body, the charging part, and the electrodes at one side of the duct. The air containing the impurities in the duct may be sucked in through the inlet port, the impurities are removed by the charging part and the electrodes, and then a remainder may be discharged through the outlet port. The duct may be provided with a pair of first partition walls protruding from a bottom surface of the main body case and extending in parallel in a direction that is perpendicular to a conveying direction of the recording medium, and a second partition wall that is connected to ends of the first partition walls, wherein a through-hole that allows the recording medium to pass therethrough is formed at a portion at which the first partition walls and the main body case contact, and the dust collecting part may be installed at other ends of the first partition walls.

The first partition walls and the second partition wall, which protrude from the bottom surface of the main body case, may block an area around a bottom surface of the ink cartridge from the outside air in order to allow the impurities to be introduced into the dust collecting part without leaking the impurities to an exterior. Therefore, the impurities are trapped by the first and the second partition walls, and removed by the dust collecting part, thereby increasing dust-collecting efficiency.

A plurality of slits may be formed at the second partition wall, of which an inner wall surface is provided with a fan that blows the air toward the collection body. The impurities collected in the first and the second partition walls, by virtue of the fan, may be more smoothly introduced into the dust collecting part, and the air may be introduced through the slits, thereby reducing an air flow resistance.

A dust collector according to the present general inventive concept may include the duct, the charging part, the electrodes, the collection body, and the fan.

The outlet port may be provided with a plurality of slits formed at the collection body, and the electrodes may be detachably attached to the inner wall surface of the collection body. In addition, in order to increase efficiency of air sucked in through the inlet port, the fan may be installed to introduce the air into the collection body.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
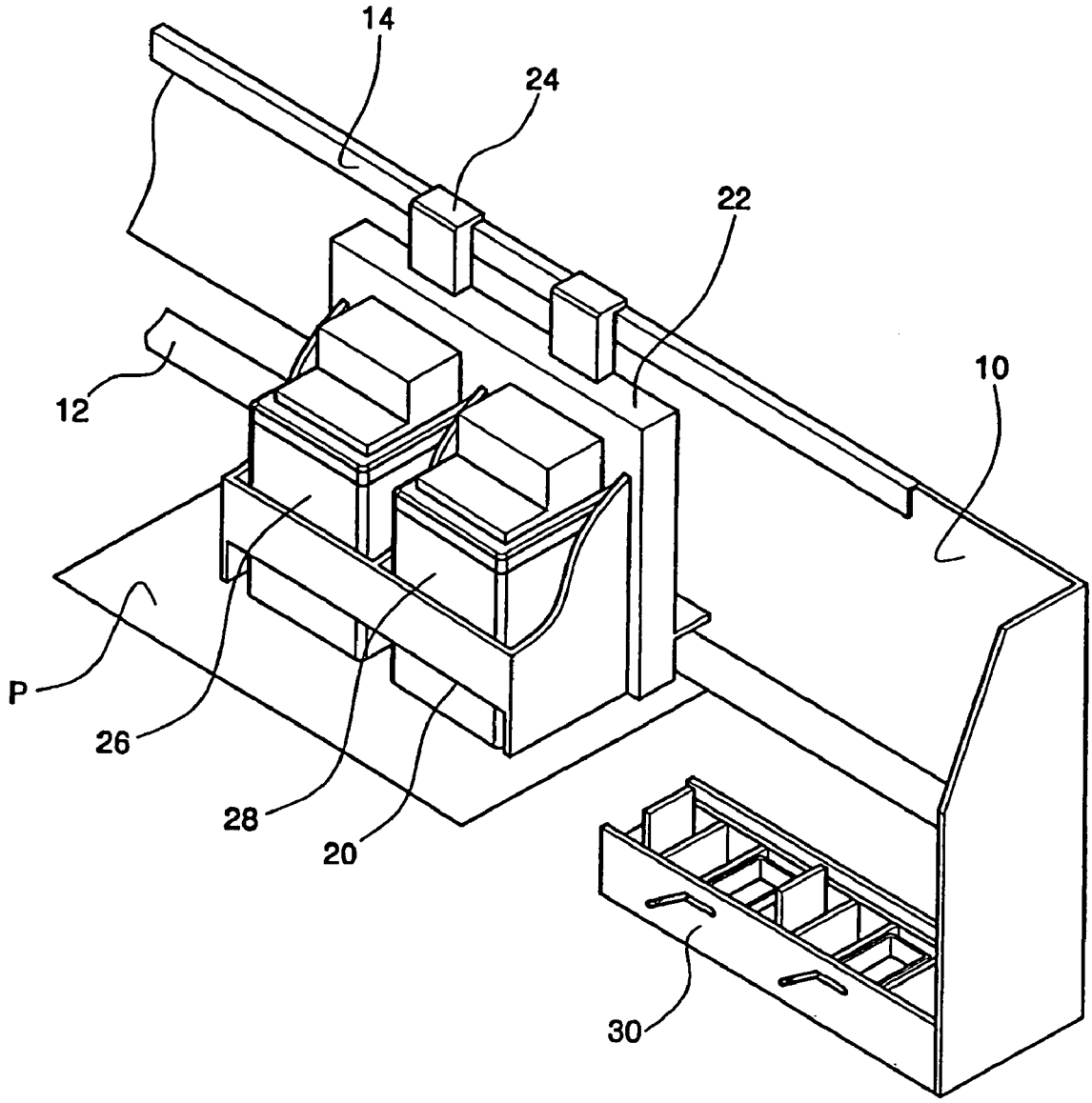
FIG. 1 (PRIOR ART)
FIG. 1 is a perspective view illustrating a conventional inkjet printer.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Hereinafter, an embodiment of an image forming apparatus provided with a dust collecting part in accordance with the present general inventive concept will be described in conjunction with the accompanying drawings.

Figure 2:
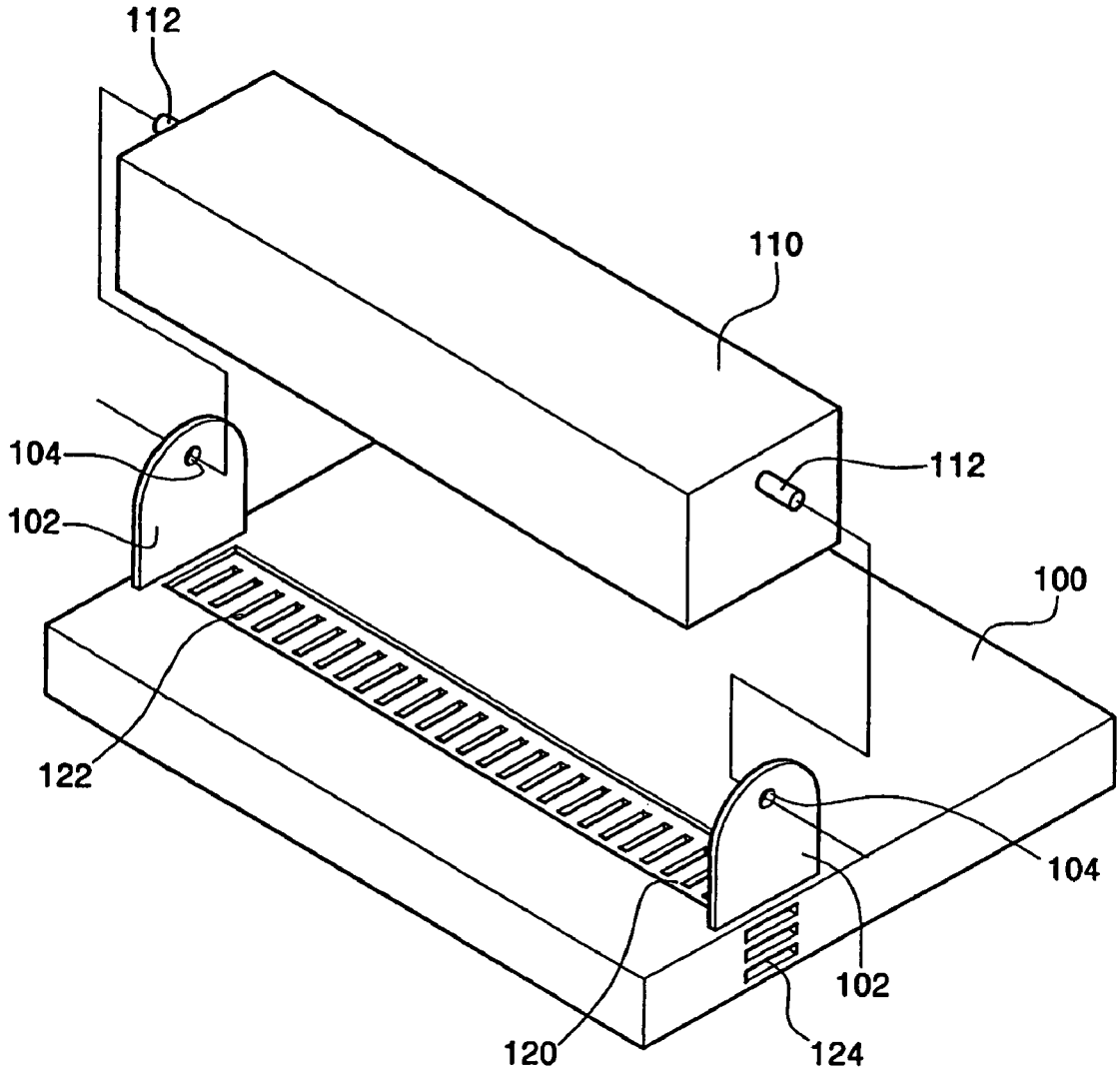
FIG. 2 is an exploded perspective view illustrating an image forming apparatus having a dust-collecting part in accordance with an image forming apparatus of the present general inventive concept.

Referring to FIG. 2, an example of an image forming apparatus having a dust collector in accordance with the present general inventive concept is shown. While not shown, this embodiment has a main body case provided with various manipulating buttons, a display part such as an LCD, and a controller that controls operation of the apparatus. The description of these parts will be omitted.

In FIG. 2, a reference numeral 100 may be a lower portion of the main body case as described above, or a separate part assembled with the main body case, but it will be referred to as a base frame herein. The base frame 100 is located on a bottom surface of the image forming apparatus, and the base frame 100 receives a recording medium to be conveyed to a lower portion of an ink cartridge 110 having a wide array type ink jet head along its bottom surface. The recording medium may be conveyed by a conveying part (not shown) such as a feed roller, for example.

The wide array type ink jet head used in accordance with the present general inventive concept may correspond to a width of the recording medium and is capable of printing on a recording medium one entire lateral line at a time. In other words, the wide array type ink jet can print an entire line on a recording medium at once. The wide array type ink jet head may extend the width of the recording medium in a longitudinal direction perpendicular to a conveying direction of the recording medium. It should be understood that the general inventive concept may also be used to collect impurities in other types of ink jet heads.

The base frame 100 is provided with a pair of vertical plates 102 that fix the ink cartridge 110 to the base frame 100. The vertical plates 102 are mounted to extend upward from a top surface of the base frame 100 and have engaging holes 104 that receive a hinge shaft 112 of the ink cartridge 110 therein. Therefore, the hinge shaft 112 of the ink cartridge 110 is fixedly inserted into corresponding ones of the engaging holes 104 to provide a space between the lower portion of the ink cartridge 110 and the top surface of the base frame 100. The vertical plates 102 may include contact terminals (not shown) that contact the wide array type ink jet head mounted on the ink cartridge 110. That is, the contact terminals may be arranged at one surface of the vertical plate 102 to be in contact with pads (not shown) formed in the ink cartridge 110 so that signals for printing are transmitted to the wide array type ink jet head. Since this contact is similar to a method of contacting a conventional ink cartridge with a carriage, their descriptions will be omitted. The ink cartridge 110 is not necessarily fixed by the vertical plates 102 formed on the base frame 100. For example, the ink cartridge 110 may be fixed in the main body case.

A cover 120 is located under the ink cartridge 110 at the top surface of the base frame 100. The cover 120 that covers a top surface of a duct 130 (see FIG. 3) may be located slightly under the top surface of the base frame 100 to have a step to the top surface of the base frame 100 (i.e., a top surface of the cover and the top surface of the base frame 100 may not be coplanar). Therefore, even when the recording medium is moved along the base frame 100, the cover 120 is not in contact with the recording medium. The cover 120 is provided with a plurality of slits 122 formed in parallel along a longitudinal direction of the cover 120. The slits function as an inlet port that sucks air into the duct 130. The air sucked into the duct 130 is discharged to an exterior through an outlet port 124 formed adjacent to one end of the duct 130.

Figure 3:
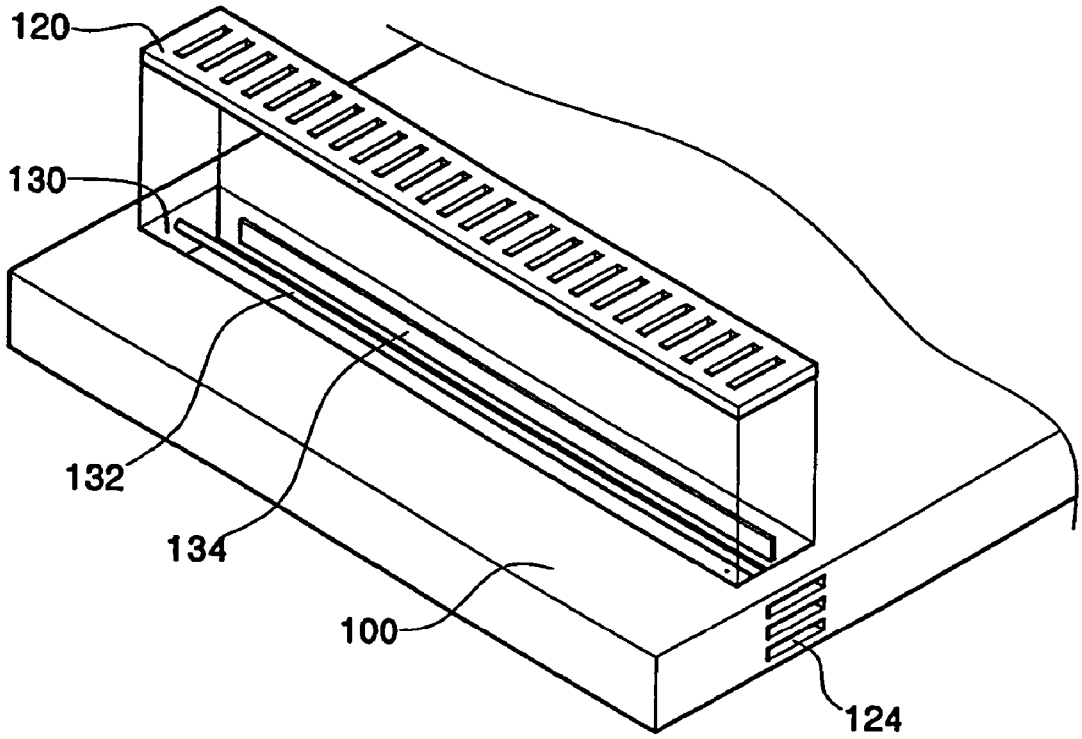
FIG. 3 is an exploded perspective view illustrating a duct of the image forming apparatus shown in FIG. 2.

Referring to FIG. 3, an inside of the duct 130 is illustrated. In FIG. 3, the vertical plates 102 are not shown in order to illustrate an inner structure of the duct 130. The duct 130 has a rectangular cross-section and a shape to extend a length of the ink cartridge 110. A length of the duct 130 is not necessarily equal to that of the ink cartridge 110, and may be shorter or longer than that of the ink cartridge 110.

A charged wire 132 is disposed in the duct 130 along a longitudinal direction of the duct 130 adjacent to the cover 120. The charged wire 132, which is negatively charged by a power supply (not shown), negatively charges various impurities (e.g., ink mists, dust, particles, etc.) contained in the air sucked into the duct 130 through the slits 122. In FIG. 3, while a single charged wire 132 is shown, a plurality of charged wires may also be used to increase charging efficiency.

Figure 4:
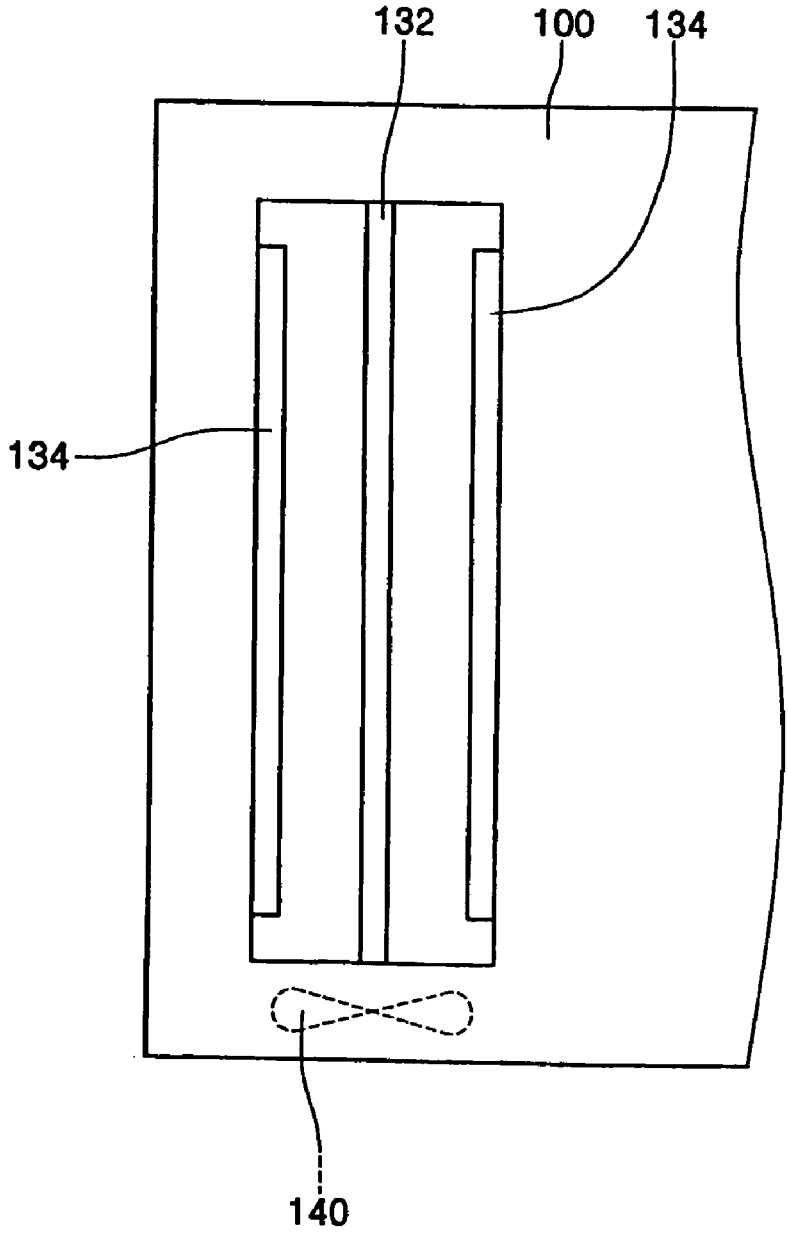
FIG. 4 is a plan view illustrating the duct shown in FIG. 3.

Electrodes 134 that adsorb the negatively charged impurities by electrical force are disposed on both sidewall surfaces (see FIG. 4) in the duct 130. The electrodes 134 have a positively charged thin plate shape and are disposed in a longitudinal direction of the duct 130. The electrodes 134 may also be attached on a bottom surface of the duct 130. The electrodes 134 may be detachably mounted to inner surfaces of the duct 130. Therefore, when surfaces of the electrodes 134 are contaminated, the electrodes 134 may be separated from the duct 130 to be cleaned separately. Additionally, it is possible to exchange the electrodes 134, when a life span of the electrodes 134 becomes exhausted.

A fan 140 is mounted at an inner side of an end portion of the duct 130, at which the outlet port 124 is formed. The fan 140 discharges the air in the duct 130 to the exterior through the outlet port 124 to generate a negative pressure in the duct 130, thereby enabling outside air above the slits 122 to be sucked into the duct 130. Thus, a dust collector according to this embodiment may include the duct 130, the charging part 132, the electrodes 134, and the fan 140.

Figure 5:
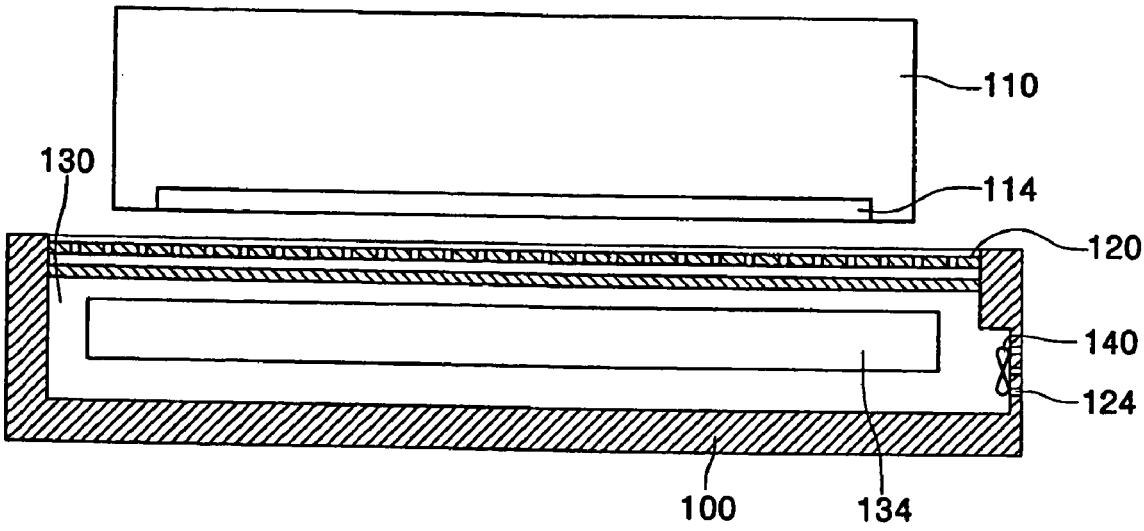
FIG. 5 is a cross-sectional view illustrating the duct shown in FIG. 3.

A method according to an embodiment of the present general inventive concept will be described with reference to FIGS. 3 and 5.

When a host, such as a personal computer, requests a printing operation, a controller (not shown) processes transmitted data to apply a pulse current to the wide array type ink jet head 114 of the ink cartridge 110. As a result, ink is ejected. The ink ejected through a nozzle of the wide array type ink jet head 114 is ejected in a droplet shape, of which a portion is ejected in a shape of numerous small ink droplets rather than a single ink droplet. These small ink droplets float in the air without arriving to a recording medium. In addition, a portion of the ink ejected on the recording medium may collide with the recording medium and be reflected therefrom back into the air. The small ink droplets, dust, and paper particles floating in the air are sucked into the duct 130 to be removed.

That is, the controller applies a negative voltage to the charged wire 132 and a positive voltage to the electrodes 134 when a printing operation of a single recording medium is completed or after an entire printing operation is completed. In this state, when the fan 140 is rotated, air that existed in the duct 130 is discharged to an exterior through the outlet port 124 by the fan 140, thereby generating a negative pressure in the duct 130. Therefore, outside air containing impurities (e.g., ink mists, dust, particles, etc.) that existed over the cover 120 is sucked into the duct 130 through the slits 122.

While the air is sucked into the duct 130, the impurities contained in the outside air are negatively charged as they come into contact with the charged wire 132. Then, the outside air is moved along the duct 130 by the fan 140. In this process, the negatively charged impurities are adsorbed to a surface of the positively charged electrodes 134. As a result, the outside air containing the impurities is passed through the duct 130 to remove the impurities, and finally discharged to the exterior through the outlet port 124.

Therefore, in the present embodiment, since the impurities are instantly sucked into the duct 130 to be removed without contacting other parts of an image forming apparatus, there is no contamination in the apparatus. Furthermore, since all components except for the fan 140 are securely maintained, a life span of the image forming apparatus is lengthened and its reliability is increased. In addition, the electrodes 134 are detachably mounted in the duct 130 to facilitate maintenance. In the present embodiment, polarities applied to the charged wire 132 and the electrodes 134 may be charged in a contrary manner to the aforementioned example.

Figure 6:
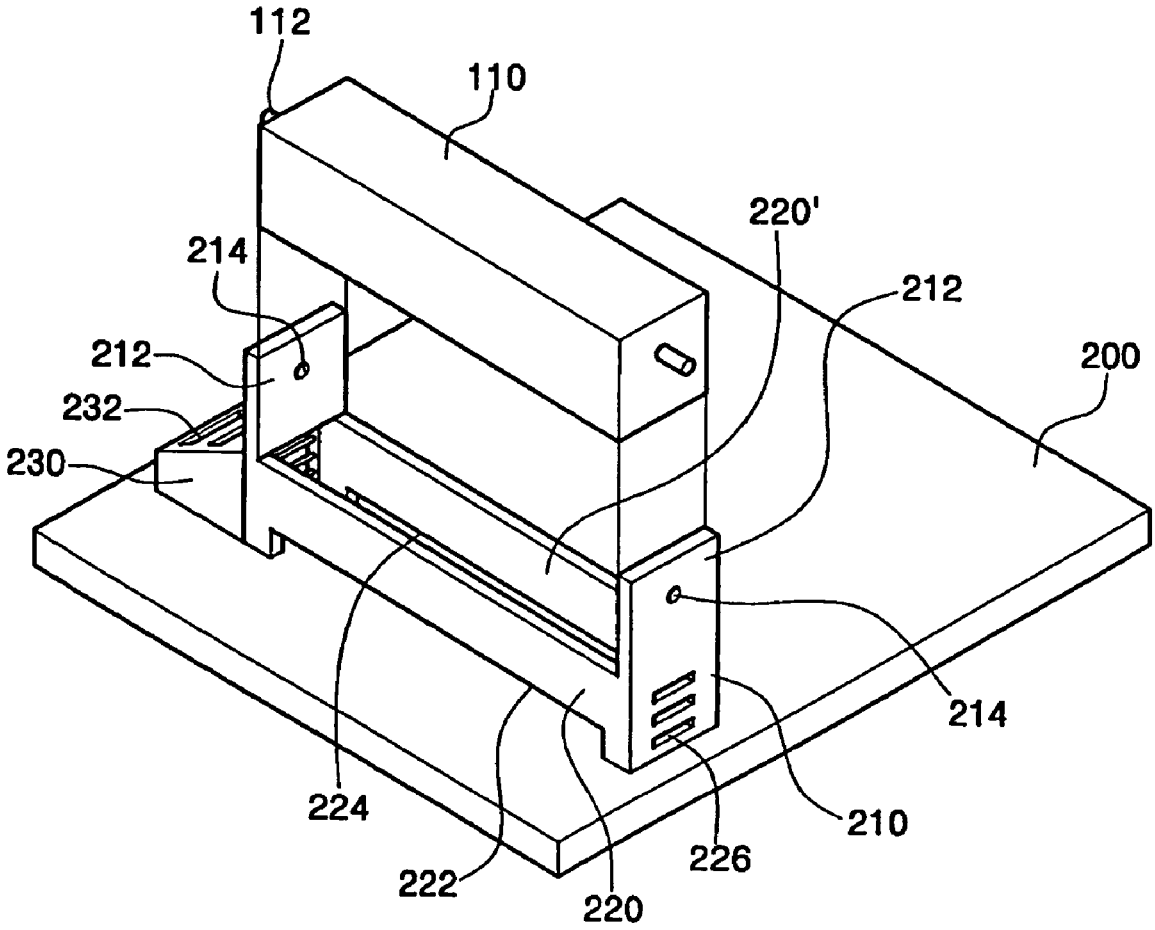
FIG. 6 is an exploded perspective view illustrating an image forming apparatus having a dust-collecting part in accordance with another embodiment of the present general inventive concept.

Referring to FIG. 6, another embodiment of an image forming apparatus in accordance with the present general inventive concept is illustrated.

Although a base frame 200 in this embodiment is similar to the base frame 100 of FIG. 2, since a duct in FIG. 6 is located above a top surface of the base frame 200 rather than in the base frame 200, the base frame 200 of FIG. 6 may have a thickness that is thinner than that of the base frame 100 of FIG. 2.

A pair of first partition walls 220 and 220' are formed at the top surface of the base frame 200. The first partition walls 220 and 220' are disposed in a lengthwise direction of the ink cartridge 110 to have a gap greater than a thickness of an ink cartridge 110 and are vertically projected from the top surface of the base frame 200. In addition, each of the first partition walls 220 and 220' are provided with through-holes 222 and 224 at their lower portions to enable a recording medium to pass therethrough. While FIG. 6 shows the through-holes 222 and 224 having a dimension larger than their real dimension, in actuality, the through-holes 222 and 224 may have a height such that only the recording medium may be passed therethrough.

A second partition wall 210 is formed at ends of the first partition walls 220 and 220' to be in contact with the first partition walls 220 and 220'. That is, the first partition walls 220 and 220' and the second partition wall 210 form a rectangular space, of which one side is open, and the rectangular space performs the same function as the duct 130 of FIG. 2.

The second partition wall 210 is provided with a plurality of slits 226 that suck in outside air, and a fan (not shown) at its inner side, thereby enabling the outside air to be introduced into the rectangular space formed between the first partition walls 220 and 220' and the second partition wall 210. Vertical plates 212 that fix the ink cartridge 110 are formed at an upper portion of the second partition wall 210 and at the other ends of the first partition walls 220 and 220'. The vertical plates 212 are provided with engaging holes 214 that receive a hinge shaft 112 of the ink cartridge 110. The vertical plates 212 may have contact terminals that contact the ink cartridge 110, similar to the other embodiments described above.

Figure 7:
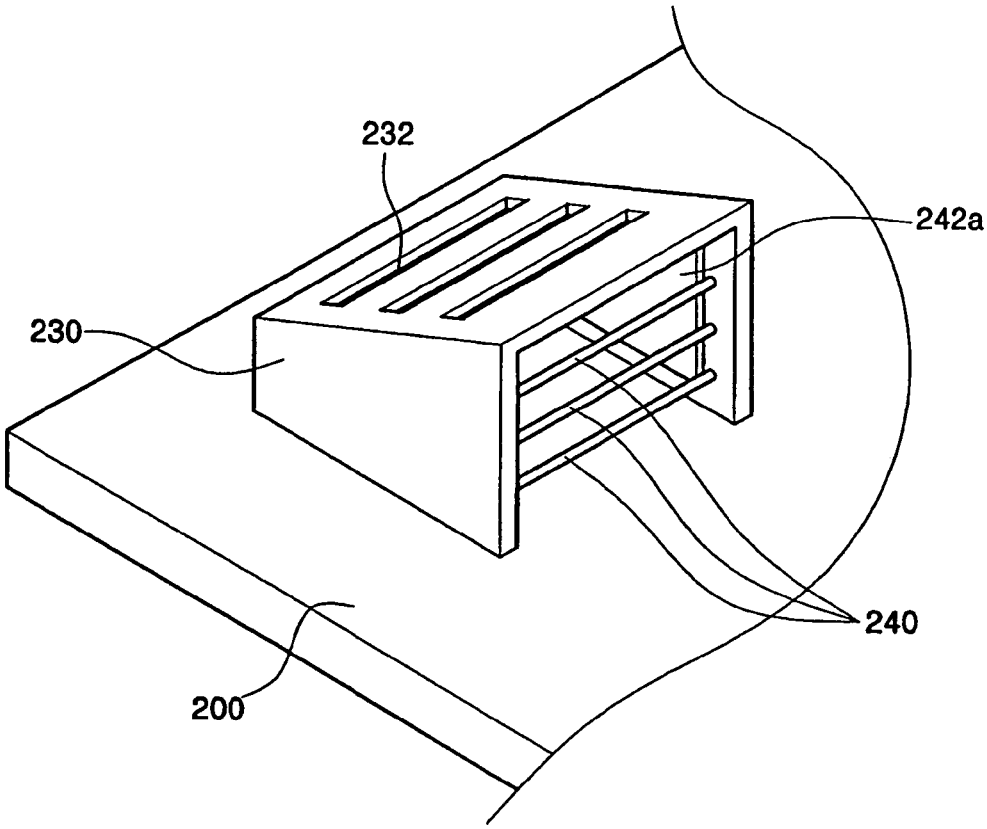
FIG. 7 is an enlarged perspective view illustrating the dust collecting part of the image forming apparatus shown in FIG. 6.

A collection body 230 having an outlet port 232 at its top surface is detachably mounted on the base frame 200 at the end portions of the first partition walls 220 and 220' facing the second partition wall 210. Referring to FIG. 7, the collection body 230 has a shape of which a height decreases as the top surface is disposed toward an end portion of the base frame 200 and away from the rectangular space. The outlet port 232 is formed to pass through the top surface of the collection body 230. In addition, the collection body 230 is provided with an end portion in contact with the first partition walls 220 and 220'. Therefore, when the ink cartridge 110 is engaged with the vertical plates 212, a portion of a bottom surface of the ink cartridge 110 is inserted into the rectangular space formed between the first partition walls 220 and 220' and the second partition wall 210 such that the first partition walls 220 and 220', the second partition wall 210 and the collection body 230 form a single enclosed space corresponding to the duct 130 in the other embodiments described above.

Figure 8:
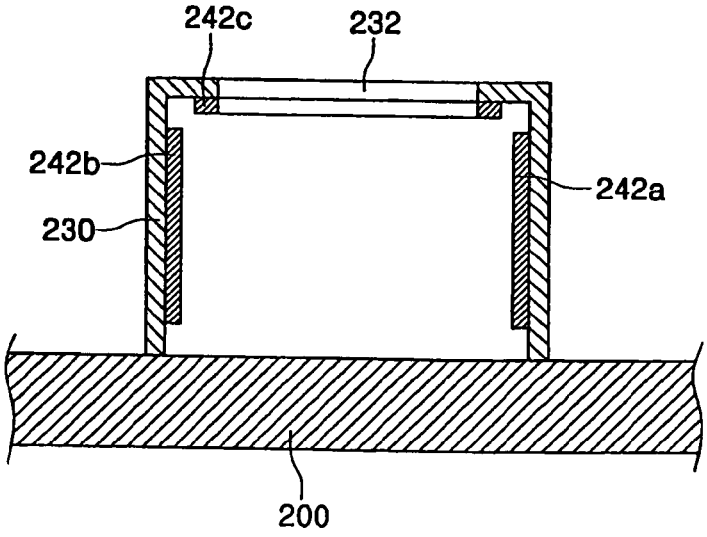
FIG. 8 is a cross-sectional view illustrating the dust collecting part shown in FIG. 7.

Three charged wires 240 are disposed across the collection body 230 at an end of the collection body 230 adjacent to the first partition walls 220 and 220' as shown in FIG. 7. In addition, three electrodes 242*a*, 242*b*, and 242*c* are attached to inner surfaces of both sidewalls and an upper wall of the collection body 230 (see FIG. 8), respectively. The charged wires 240 are charged to apply a negative voltage and the electrodes 242*a*, 242*b* and 242*c* are charged to apply a positive voltage.

Therefore, when the fan (not shown) installed at an inner side of the second partition wall 210 is rotated, the outside air is introduced into the rectangular space between the first partition walls 220 and 220' through the slits 226, and the outside air allows the impurities floating between the ink cartridge 110 and the base frame 200 to move along the first partition walls 220 and 220' to flow toward the collection body 230. Only a portion of the air may leak through the through-holes 222 and 224, since the height of the through-holes 222 and 224 may be such that only the recording medium may pass therethrough.

The impurities that flow into the collection body 230 pass the charged wires 240 to have a negatively charged polarity, and the charged impurities are adsorbed to the electrodes 242*a*, 242*b* and 242*c* attached to inner walls of the collection body 230 while remaining air is discharged to the exterior through the outlet port 232. Since the collection body 230 is detachably mounted to the base frame 200, the collection body 230 may be separated from the base frame 200 to clean the electrodes 242*a*, 242*b* and 242*c* when the electrodes 242*a*, 242*b*, and 242*c* become contaminated. The electrodes may also be detachably mounted on the inner walls of the collection body 230. When a life span of the electrodes 242*a*, 242*b*, and 242*c* becomes exhausted, it is possible to exchange the electrodes easily.

Thus, a dust collector according to this embodiment may include the duct formed by the first partition walls 220 and 220' and the second partition wall 210, the electrodes 242*a*, 242*b*, and 242*c*, the collection body 230, the fan (not shown), and the charging part 240. Since this embodiment employs the base frame 200, to which a thickness is not limited, a degree of design freedom may be increased, and the collecting part has a small size and may be separated from the base frame 200 to make its maintenance easy.

In accordance with the present general inventive concept, the image forming apparatus includes a dust-collecting part that adsorbs impurities over an entire region of the wide array type ink jet head, thereby effectively removing the impurities generated in large quantities in comparison with the conventional ink jet head. The present general inventive concept increases a life span and reliability of image forming apparatuses, since the dust collecting part is securely maintained during operation.

In addition, since electrodes and the dust collecting part are detachably mounted, they may be readily exchanged when they become contaminated or cease to function properly due to long term use. This facilitates maintenance.

Although a few embodiments of the present general inventive concept have been shown and described, it will be appreciated by those skilled in the art that changes may be made to these embodiments without departing from the general principles and spirit of the general inventive concept, the scope of which is defined in the appended claims and their equivalents.

What is claimed is:

1. An image forming apparatus comprising:

an ink cartridge having a wide array type ink jet head to eject ink over an entire lateral line that is perpendicular to a conveying direction of a recording medium at a time;

a main body case that supports the ink cartridge;

a duct located under the wide array type ink jet head, and to extend in a longitudinal direction of the wide array type ink jet head; and a dust collecting part including a charging part disposed in the duct to charge impurities and electrodes disposed in the duct to adsorb the charged impurities.

2. The image forming apparatus according to claim 1, wherein the charging part has at least one wire disposed in a longitudinal direction of the duct, and the electrodes are attached to an inner wall surface of the duct.

3. The image forming apparatus according to claim 2, wherein the electrodes are attached on two sidewall surfaces of the duct.

4. The image forming apparatus according to claim 2, wherein one of the electrodes is attached on a bottom surface of the duct.

5. The image forming apparatus according to claim 2, wherein the electrodes are detachably mounted on the duct.

6. The image forming apparatus according to claim 1, further comprising:

a fan mounted on one end of the duct to discharge air in the duct.

7. The image forming apparatus according to claim 1, wherein the main body case further comprises a groove formed under the ink cartridge at a bottom surface of the main body case as the duct.

8. The image forming apparatus according to claim 7, further comprising:

a cover mounted on an upper portion of the groove and having a plurality of slits.

9. The image forming apparatus of claim 8, wherein a recording medium being conveyed along the main body case does not contact the top surface of the cover.

10. The image forming apparatus according to claim 1, wherein a length of the duct is greater than or equal to a length of the ink cartridge.

11. The image forming apparatus according to claim 1, wherein the main body case further comprises one or more vertical plates protruding from a bottom surface of the main body case and having an engaging hole to fix a hinge shaft of the ink cartridge therein such that the wide array type ink jet head is disposed above the duct.

12. The image forming apparatus according to claim 1, further comprising:

a fan to move air from a first side of the duct to a second side of the duct such that impurities in the air are charged by the charged part and the charged impurities are adsorbed by the electrodes while the air is being moved from the first side of the duct to the second side of the duct.

13. An image forming apparatus comprising:

an ink cartridge having a wide array type ink jet head to eject ink over an entire lateral line that is perpendicular to a conveying direction of a recording medium at a time; and a main body case that supports the ink cartridge, a duct protruding from a bottom surface of the main body case, and into which a portion of a bottom surface of the ink cartridge is inserted;

a collection body disposed at a second end of the duct, and having an inlet port that receives air from in the duct and an outlet port that discharges air from the duct;

at least one charging part disposed at the inlet port to charge impurities that are received from in the duct; and electrodes attached to an inner wall surface of the collection body to adsorb the charged impurities.

14. The image forming apparatus according to claim 13, wherein the duct comprises:

a pair of first partition walls protruding from the bottom surface of the main body case and extending in parallel in a direction that is perpendicular to the conveying direction of the recording medium.

15. The image forming apparatus of claim 14, wherein the duct further comprises a second partition wall connected to first ends of the first partition walls, wherein the first partition walls form a through-hole with the bottom surface of the main body case to allow the recording medium to pass therethrough, and the collection body is installed at second ends of the first partition walls.

16. The image forming apparatus according to claim 15, wherein the second partition wall has a plurality of slits, and the duct comprises a fan that blows air toward the collection body.

17. The image forming apparatus according to claim 13, wherein the outlet port comprises a plurality of slits formed at the collection body.

18. The image forming apparatus according to claim 13, wherein the electrodes are detachably mounted to an inner wall surface of the collection body.

19. The image forming apparatus according to claim 13, further comprising:

a fan installed in the duct to introduce air into the collection body.

20. The image forming apparatus according to claim 13, wherein the duct includes a rectangular space formed by a pair of first partition walls protruding from the main body case, a second partition wall protruding from the main body case and attached at a first end of the pair of first partition walls, and the collection body mounted on the main body case and adjacent to a second end of the pair of first partition walls.

21. The image forming apparatus according to claim 20, wherein the pair of first partition walls form a through hole with the bottom surface of the main body case to pass a printing medium therethrough in a direction perpendicular to a longitudinal direction of the duct.

22. The image forming apparatus according to claim 20, further comprising:

a fan that moves air from the second partition wall of the duct to the collection body.

23. The image forming apparatus according to claim 22, wherein the fan creates a negative air pressure in the duct such that air with impurities is sucked into the duct through one or more slits on the second partition wall of the duct.

24. The image forming apparatus according to claim 20, wherein the at least one charged wire charges the impurities in the air received at the inlet port with a first polarity and the electrodes are charged with a second polarity opposite to the first polarity to adsorb the charged impurities.

25. The image forming apparatus according to claim 13, wherein the charging part comprises at least one charged wire disposed across the inlet port of the collection body.

26. A method of an image forming apparatus, the method comprising:

receiving air that contains impurities into a duct that corresponds to a length of an ink jet head, wherein the air that contains impurities is received through one or more slits on a first side of the duct and the air that contains impurities is received from an area around the ink jet head;

moving the air in the duct toward a collection body that is mounted at a second side of the duct that is opposite to the first side;

charging the impurities in the air using a charging part disposed in an inlet port of the collection body;

adsorbing the charged impurities in the air using electrodes mounted on inner surfaces of the collection body; and discharging air with the impurities substantially removed from an outlet port of the collection body.

27. The method according to claim 26, wherein moving the air in the duct further comprises:

moving the air in the duct toward a collection body that is mounted at a second side of the duct by creating a negative air pressure in the duct using a fan that is mounted inside of the duct.

28. The method of claim 27, wherein the air that contains impurities is received from an area around a wide array type ink jet head.

* * * * *